US007244351B2

(12) United States Patent
Báez et al.

(10) Patent No.: US 7,244,351 B2
(45) Date of Patent: Jul. 17, 2007

(54) DESULFURIZATION PROCESS OF HYDROCARBON FEEDS WITH ELECTROLYTIC HYDROGEN

(75) Inventors: Victor Báez Báez, Caracas (VE); Diego Sánchez M., Caracas (VE)

(73) Assignee: Intevep, S.A., Caracas (VE)

( * ) Notice: Subject to any disclaimer, the term of this patent is extended or adjusted under 35 U.S.C. 154(b) by 333 days.

(21) Appl. No.: 10/984,462

(22) Filed: Nov. 8, 2004

(65) Prior Publication Data

US 2006/0102523 A1 May 18, 2006

(51) Int. Cl.
*C10G 45/00* (2006.01)

(52) U.S. Cl. ..... 208/209; 208/208 R; 208/308; 204/168

(58) Field of Classification Search ..... 208/209, 208/208 R, 207, 308; 204/168
See application file for complete search history.

(56) References Cited

U.S. PATENT DOCUMENTS 5,981,097 A * 11/1999 Rajendran ..... 429/33
6,132,590 A * 10/2000 Moran et al. ..... 205/496
6,475,376 B2 * 11/2002 Jossens et al. ..... 208/213
6,653,005 B1 * 11/2003 Muradov ..... 429/19
7,001,504 B2 * 2/2006 Schoonover ..... 208/236
7,025,875 B2 * 4/2006 Grieve et al. ..... 208/208 R

* cited by examiner

*Primary Examiner*—Glenn A. Caldarola
*Assistant Examiner*—John Douglas
(74) *Attorney, Agent, or Firm*—Bachman & LaPointe, P.C.

(57) ABSTRACT

A process for removing sulfur from hydrocarbon feeds, including the steps of providing a hydrocarbon feed containing sulfur; providing a cell having two compartments and a membrane separating the compartments; flowing a hydrogen source through one compartment; flowing the hydrocarbon feed through the other compartment; applying a current across the hydrogen source compartment whereby hydrogen diffuses through the membrane from the hydrogen source to the hydrocarbon feed, whereby the hydrogen reacts with sulfur to form $H_2S$ and produce a treated hydrocarbon.

17 Claims, 1 Drawing Sheet

DESULFURIZATION PROCESS OF HYDROCARBON FEEDS WITH ELECTROLYTIC HYDROGEN

BACKGROUND OF THE INVENTION

The invention relates to desulfurization of hydrocarbon feeds.

Environmental concerns regarding hydrocarbons such as gasoline and diesel, and sulfur specifications in connection with same, continue as an important issue. These specifications are designed to reduce vehicular emissions, specifically, SOx generated in the combustion of such fuels.

It is expected that regulations will soon require gasoline and diesel quality to have sulfur levels less than or equal to about 30 ppm in the United States, and 50 ppm in Western Europe. These regulations will only become more stringent as time goes on.

It is expected that legislation, especially that in the U.S.A. and Japan, will call for "sulfur free" gasoline and diesel fuel by the end of this decade.

Although technologies exist for deep sulfur removal from hydrocarbon feeds, this technology does not necessarily provide an economically attractive solution to achieve the required low sulfur specifications.

Conventional hydrodesulfurization requires high temperatures, expensive equipment and potentially expensive additives, all of which leads to commercially unattractive processes.

It is clear that the need remains for a process for deep desulfurization of hydrocarbon feeds, which is economically attractive and efficient.

It is therefore the primary object of the present invention to provide such process.

It is a further object of the present invention to provide a process which can be carried out at less extreme temperatures and pressures.

Other objects and advantages of the present invention will appear herein below.

SUMMARY OF THE INVENTION

In accordance with the present invention, the foregoing objects and advantages have been readily obtained.

According to the invention, a process is provided for removing sulfur from hydrocarbon feeds, which process comprises the steps of providing a hydrocarbon feed containing sulfur; providing a cell having two compartments and a membrane separating the compartments; flowing a hydrogen source through one compartment; flowing the hydrocarbon feed through the other compartment; applying a current across the hydrogen source compartment whereby hydrogen diffuses through the membrane from the hydrogen source to the hydrocarbon feed, whereby the hydrogen reacts with sulfur compounds to form $H_2S$ and provide a treated hydrocarbon.

BRIEF DESCRIPTION OF THE DRAWINGS

A detailed description of preferred embodiments of the present invention follows, with reference to the attached drawings, wherein.

DETAILED DESCRIPTION

The invention relates to a desulfurization process and, more particularly, to a process for generating electrolytic hydrogen in situ, for desulfurization of hydrocarbon feeds.

In accordance with the present invention, hydrogen is permeated across a membrane and exposed to a hydrocarbon feed containing sulfur, wherein the hydrogen, in atomic form, reacts with the sulfur to remove the sulfur from different cyclic and other types of compounds, and transforms the sulfur compounds into $H_2S$ which is more easily removed from the hydrocarbon.

According to the invention, an electrochemical cell is used to take hydrogen, for example from water or any other suitable hydrogen source, and permeate the hydrogen across a membrane into contact with a hydrocarbon containing the sulfur hydrocarbon compounds.

Figure 1:
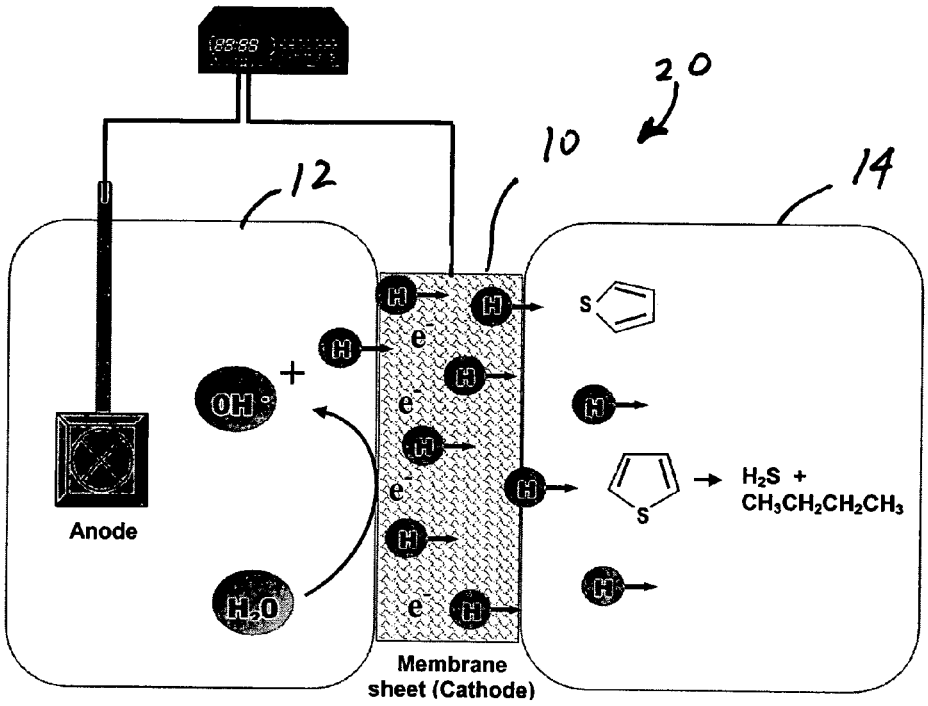
FIG. 1 schematically illustrates a process in accordance with the present invention.

FIG. 1 shows a process in accordance with the present invention wherein a membrane sheet 10 is positioned between two compartments or flow areas 12, 14, and wherein a hydrogen source material is passed through one flow area 12 while the hydrocarbon containing sulfur is passed through the other flow area 14. Applying a current across the metallic sheet configures the first flow area 12 as anode and membrane sheet 10 as cathode. The applied current serves to separate off hydrogen in atomic form on the surface of membrane sheet 10, which then permeates through this membrane and into flow area 14 where the extremely reactive hydrogen couples with sulfur to form $H_2S$ and produce cyclic hydrocarbons without the sulfur. It is believed that the hydrogen may also serve to upgrade the quality of the feed, and this is a secondary beneficial effect of the process of the present invention. The hydrocarbon feed may include gasoline, diesel, jet fuel and other feeds.

In accordance with the present invention, the electrochemical cell 20, including membrane 10 and compartments 12, 14, is provided including a membrane which advantageously is electrically conductive and stable as cathode during electrolysis.

The membrane sheet can advantageously comprise at least one material selected from the group consisting of iron, iron alloys, nickel, gold, platinum, palladium, palladium alloys and mixtures thereof. These materials are found to be excellent for use in separating hydrogen from a hydrogen source and permeating the hydrogen through the membrane. It may also be advantageous to deposit a porous layer of metals on a membrane sheet such as palladium, gold, silver, nickel, copper, lead and other metallic elements belonging to the platinum group. The reason is that the porous layer may act as a catalytic layer for permeating atomic hydrogen. This deposition can be carried out by permeation of electrolytic hydrogen generated "in situ".

In further accordance with the invention, the anode or flow compartment 12 can advantageously comprise a material selected from the group consisting of platinum, nickel, iron, iron alloys, gold, palladium and mixtures thereof, for similar reasons.

The membrane can advantageously have a thickness of between about 0.005 and about 2.5 mm.

Such a membrane is effective in the process of the present invention when a current is applied across the same at a current density of between about 1.6 and about 80 $mA/cm^2$.

In further accordance with the invention, a solution is advantageously provided at the hydrogen source side of the membrane. This solution can be alkaline solution, acid solution or just water, and can also advantageously be provided as an electrolyte solution, most preferably as sodium hydroxide, potassium hydroxide, calcium hydroxide and the like. This solution can advantageously be provided in a concentration of between about 0.01 M and 10 M.

Electrolytic cells such as that described in accordance with the process of the present invention are well known in hydrogen generating arts, and further details as to specific operating structures and parameters would be known to a person of ordinary skill in the art.

Figure 2:
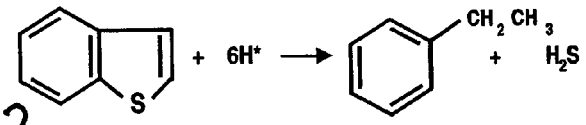
FIG. 2 further illustrates a reaction in accordance with the process of the present invention.

In further accordance with the specific process of the present invention, one particularly difficult sulfur-containing compound which is commonly present in hydrocarbon feeds is thiophene. A thiophene molecule is shown in FIG. 2, and contains sulfur in a location where it is difficult to remove. It has been found in accordance with the present invention, however, that these thiophene compounds, when exposed to atomic hydrogen, are converted so as to remove the sulfur from the compound and form $H_2S$, and a substantially sulfur free hydrocarbon. This is advantageous since the $H_2S$ is now in an easily removed form, and the remaining hydrocarbon does not contain the removed sulfur.

In further accordance with the present invention, the process can be carried out at a temperature of between about 25° C. and about 300° C. These temperatures are advantageously substantially lower than conventional hydro-desulfurization processes.

In accordance with the invention, atomic hydrogen permeating through the membrane can react with sulfur organic compounds either at the surface of membrane 10, upon contacting the hydrocarbon, or in the interface between the solution and membrane sheet.

It may be desirable in accordance with the process of the present invention to circulate the hydrocarbon feed within the second flow area or compartment 14, so as to increase the contact efficiency between the sulfur organic compounds and the membrane sheet through which hydrogen permeates.

The reaction can be carried out at flow rates through the chambers or the compartments of the cell which are sufficient to allow sulfur organic compounds to be removed to a desired level.

In accordance with the present invention, the process provided advantageously allows for deep desulfurization of hydrocarbon feedstocks with or without a minimal yield loss, and further provides for removal of sulfur at low severity temperatures and pressures. This is particularly desirable as the quality of the hydrocarbon itself is thereby maintained and potentially, improved. In addition, there is no evidence of loss of activity of the membrane sheet during the reaction, and further the process does not have a hydrogen efficiency decay as is experienced with conventional hydrodesulfurization methods. This is due to the fact that hydrogen is continuously supplied electrolytically and, therefore, the sulfur removal process is continuously conducted. Furthermore, the rate of sulfur compound removal can be controlled by regulating the current density.

The following examples demonstrate the process in accordance with the present invention.

EXAMPLE 1

A preliminary experiment was conducted using thiophene as a model molecule, and was carried out utilizing an electrolytic solution of NaOH concentrated at 0.1 M, a current density of 2 mA/cm$^2$, a cathode surface in the form of palladium black, a cathode thickness of 0.0625 mm, a platinum mesh anode, a reaction temperature of 60° C., regular agitation, a feed in the form of 100 ml of heptane containing 480 ppm of sulfur in the form of thiophene, and electrolysis time of 24 hours.

Figure 3:
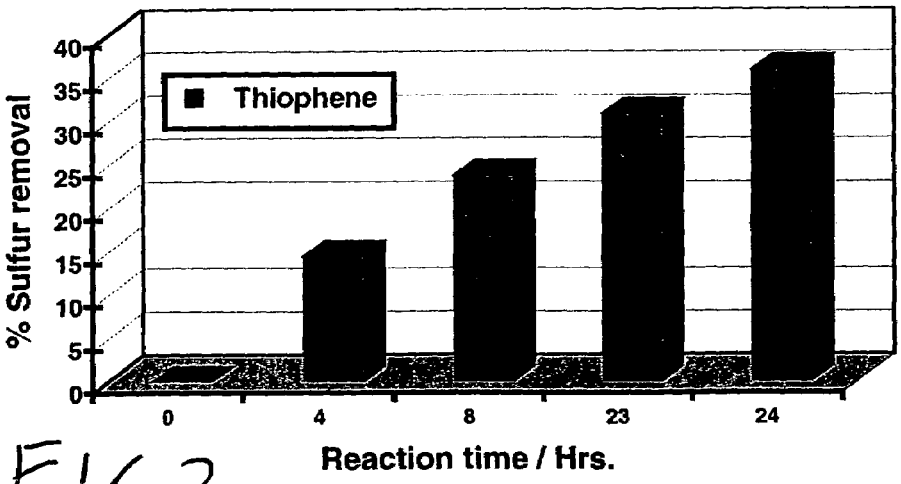
FIG. 3 sets forth sulfur removal following a process in accordance with the present invention.

FIG. 3 shows the effectiveness of sulfur removal utilizing the process of the present invention, and shows a 40% removal of sulfur after 24 hours of reaction. This is particularly impressive in light of the fact that the conditions used for this experiment are clearly not the most favorable.

EXAMPLE 2

A further experiment was conducted utilizing diesel as the hydrocarbon feed. The process was carried out utilizing NaOH 0.1 M as the electrolytic solution, a current density of 15.2 mA/cm$^2$, a cathode surface in the form of palladium black, a platinum mesh anode, reaction temperature of 60° C., constant agitation, a feedstock of 40 ml of diesel containing 106 ppm sulfur, and an electrolysis time of 24 hours.

The results for this testing are set forth in table 1 below.

TABLE 1

| | ORIGINAL DIESEL | OBTAINED DIESEL |
|---|---|---|
| Density at 15° C. | 0.8584 g/ml | 0.8592 g/ml |
| Cetane Index | 48 | 49.9 |
| Nitrogen | 21 ppm | 19 ppm |
| Sulfur | 106 ppm | 92 ppm |
| Olefins | 4.03% | 0% |

As set forth in Table 1, these results confirm sulfur removal from the diesel fuel as well.

In accordance with the present invention, it should be readily appreciated that a process has been provided for utilizing electrolysis to generate hydrogen "in situ" for removal of sulfur from hydrocarbon feed stocks. The resulting hydrocarbon product has a reduced content of sulfur in this form, and can further have upgraded components or quality as well. The process is carried out at significantly lower temperatures and pressures then conventional hydro desulfurization processes and can be utilized to remove sulfur with an excellent efficiency.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for removing sulfur from hydrocarbon feeds, comprising the steps of:

providing a hydrocarbon feed containing sulfur;

providing a cell having two compartments and a membrane separating the compartments;

flowing a hydrogen source through one compartment;

flowing the hydrocarbon feed through the other compartment; and applying a current across the hydrogen source compartment whereby hydrogen is generated on a surface of the membrane and diffuses through the membrane from the hydrogen source to the hydrocarbon feed, whereby the hydrogen reacts with sulfur to form $H_2S$ and provide a treated hydrocarbon.

2. The process of claim 1, furthers comprising the step of removing the $H_2S$.

3. The process of claim 1, wherein the hydrocarbon feed is selected from the group consisting of gasoline, diesel, jet fuel and combinations thereof.

4. The process of claim 1, wherein the hydrocarbon feed contains sulfur in different types of compounds, and wherein the hydrogen reacts with these different types of compounds to form the $H_2S$ and desulfurized cyclic compounds.

5. The process of claim 1, wherein the process is carried out at a temperature of between about 25° C. and about 300° C.

6. The process of claim 1, wherein the membrane is electrically conductive and stable as a cathode during electrolysis so as to provide one of the electrodes.

7. The process of claim 6, wherein the membrane comprises at least one material selected from the group consisting of iron, iron alloys, nickel, gold, platinum, palladium, palladium alloys, and mixtures thereof.

8. The process of claim 7, wherein deposition of metals on surfaces of the membrane provides for an upgrade in atomic hydrogen permeation.

9. The process of claim 7, wherein the anode comprises a material selected from the group consisting of platinum, nickel, iron, iron alloys, gold, palladium and mixtures thereof.

10. The process of claim 1, wherein the membrane has a thickness of between about 0.005 and about 2.5 mm.

11. The process of claim 1, wherein the hydrogen which diffuses across the membrane is atomic hydrogen.

12. The process of claim 1, wherein the hydrocarbon feed comprises sulfur in the form of thiophene compounds, and wherein the treated hydrocarbon has a reduced amount of sulfur in the form of thiophene compounds as compared to the feed.

13. The process of claim 1, wherein the applying step comprises applying current at a current density of between about 1.6 and about 80 $mA/cm^2$.

14. The process of claim 1, further comprising the step of providing a solution for generating atomic hydrogen at the hydrogen source side of the membrane.

15. The process of claim 14, wherein the solution is selected from the group consisting of alkaline solutions, acid solutions water and combinations thereof.

16. The process of claim 14, wherein the solution is an electrolyte solution.

17. The process of claim 14, wherein the solution comprises sodium hydroxide solution at a concentration of between about 0.01 M and about 10 M.

* * * * *